US005229184A

United States Patent [19]

Campbell et al.

[11] Patent Number: 5,229,184

[45] Date of Patent: Jul. 20, 1993

[54] HEAT SHRINKABLE FIBRES AND PRODUCTS THEREFROM

[75] Inventors: Frederick S. Campbell, West Mansfield; Gordon J. Varney, North Easton; DeWitt R. Petterson, Dover, all of Mass.

[73] Assignee: Albany International Corporation, Memands, N.Y.

[21] Appl. No.: 315,118

[22] Filed: Feb. 24, 1989

Related U.S. Application Data

[63] Continuation-in-part of Ser. No. 182,134, Apr. 14, 1988, abandoned, and a continuation-in-part of Ser. No. 182,286, Apr. 15, 1988, abandoned, and a continuation-in-part of Ser. No. 266,108, Nov. 2, 1988, abandoned, and a continuation-in-part of Ser. No. 266,109, Nov. 2, 1988, abandoned.

[51] Int. Cl.[5] ..... D04H 1/46; D04H 1/50; B32B 5/06; B32B 5/08; B32B 5/14

[52] U.S. Cl. ..... 428/113; 28/104; 28/112; 156/84; 156/85; 156/86; 264/230; 264/257; 264/DIG. 71; 428/120; 428/174; 428/234; 428/235; 428/236; 428/252; 428/253; 428/286; 428/287; 428/296; 428/297; 428/299; 428/301; 428/302; 428/473.5; 428/913

[58] Field of Search ..... 28/104, 112; 156/84, 156/85, 86; 428/113, 120, 234, 235, 236, 252, 253, 286, 287, 296, 297, 299, 301, 302, 473.5, 913, 174; 264/230, 257, DIG. 71

[56] References Cited

U.S. PATENT DOCUMENTS

| | | | |
|---|---|---|---|
| 2,262,861 | 11/1941 | Rugeley et al. | 264/DIG. 71 |
| 2,609,539 | 9/1952 | Sherer . | |
| 3,395,066 | 7/1968 | Tucker | 264/DIG. 71 |
| 3,398,311 | 8/1968 | Mitchell et al. | 264/DIG. 71 |
| 3,510,389 | 5/1970 | Olson . | |
| 3,917,448 | 11/1975 | Wood | 156/622 |
| 3,985,951 | 10/1976 | Harris | 264/230 |
| 4,086,378 | 4/1978 | Kam | 264/257 |
| 4,113,537 | 9/1978 | Schäfer et al. . | |
| 4,155,970 | 5/1977 | Cassell | 264/230 |
| 4,172,172 | 10/1979 | Suzuki et al. | 428/288 |
| 4,155,970 | 5/1978 | Jaskowski | 428/288 |
| 4,172,172 | 10/1979 | Winson . | |
| 4,237,180 | 12/1980 | Linhart et al. | 156/85 |
| 4,472,702 | 9/1984 | Johansson | 264/230 |
| 4,515,854 | 5/1985 | Kogame et al. | 428/288 |
| 4,551,378 | 11/1985 | Carey | 428/288 |
| 4,726,987 | 2/1988 | Trask et al. . | |
| 4,729,920 | 3/1988 | McLoughlin et al. | 156/86 |
| 4,731,277 | 3/1988 | Groitzsch et al. | 156/85 |
| 4,734,311 | 3/1988 | Sokolowski | 428/288 |
| 4,833,012 | 5/1989 | Makimura et al. | 428/288 |

FOREIGN PATENT DOCUMENTS

| | | |
|---|---|---|
| 181300 | 5/1986 | European Pat. Off. . |
| 187236 | 7/1986 | European Pat. Off. . |
| 247232 | 12/1987 | European Pat. Off. . |
| 2013912 | 10/1970 | Fed. Rep. of Germany . |
| 1303780 | 10/1972 | Fed. Rep. of Germany . |
| 2458038 | 8/1976 | Fed. Rep. of Germany . |
| 993473 | 5/1965 | United Kingdom . |
| 1248778 | 10/1971 | United Kingdom . |
| 1264820 | 2/1972 | United Kingdom . |
| 2096048 | 10/1982 | United Kingdom . |

*Primary Examiner*—James C. Cannon

*Attorney, Agent, or Firm*—Ostrolenk, Faber, Gerb & Soffen

[57] ABSTRACT

This invention relates to a composition of matter having a fibre structure incorporating a major proportion of heat shrinkable fibres, the structure includes within it discreet fibre groupings which serve to provide structural elements within the composition. The composition of the invention is capable of being formed to provide shaped products. A particular aspect of the invention relates to compositions comprising flame retardant fibres typically polyimide fibres which enables the production of flame retardent compositions. The density of the structures can be controlled as can the rigidity thereof.

25 Claims, 11 Drawing Sheets

HEAT SHRINKABLE FIBRES AND PRODUCTS THEREFROM

This is a continuation-in-part of our applications Ser. No. 182,134, filed Apr. 14, 1988, now abandoned, Ser. No. 182,286, filed Apr. 15, 1988, now abandoned, Ser. No. 266,108, filed Nov. 2, 1988, now abandoned and Ser. No. 266,109, filed Nov. 2, 1988, now abandoned.

DESCRIPTION

This invention relates to novel compositions of matter having a fibrous structure and includes novel fibre compositions having flame retardant high temperature resistant properties which compositions are capable of being processed into a number of specific novel products.

It is generally known that when most types of stretched synthetic fibres are heated to around their stretching temperature they tend to contract. For example, polyolefins, polyesters, polyvinyl chloride and polyamide fibres in particular, shrink between 10–50% under these conditions. The fibres are endowed with this property during the production process. In the manufacture of such fibres it is common practice to stretch the fibres after spinning in order to orientate the polymer molecules therein. This orientation is initially retained because strong inter-molecular forces between molecules prevent the elongated molecules themselves from contracting and retangling by relaxation. These strong inter-molecular forces, however, can be overcome at elevated temperatures by entropic relaxation allowing the fibre to reach a state whereby a contracting force develops and the fibre shrinks.

There is a requirement for materials which are light weight, which have structural integrity and strength based on a fibrous construction and which preferably have reduced flammability compared with existing materials.

Therefore, it is an object of this invention to provide fibre structures from heat shrinkable fibres, preferably with good thermal properties, such, for example, as polyimide fibres, which structures may be easily converted by heating into shaped articles. The articles may exhibit structural integrity i.e. high tensile strength, combined with light weight and preferably high heat resistance and flame retardancy depending on their method of formation. Such shaped articles may also be capable of being readily worked and machined after forming.

According to one aspect of the present invention there is provided a composition of matter comprising a fibre structure at least a major proportion of which comprises heat shrinkable fibres, which structure has been heat treated to produce fibre to fibre bonding at least some of the fibre to fibre contact points.

In another aspect of the present invention there is provided a composition of matter comprising a fibre structure, a major proportion of which consists of heat shrinkable fibres which have been heat treated to produce densification of the structure.

A further aspect of the invention provides a composition of matter comprising a fibre structure including a major proportion of heat shrinkable fibres, said structure including discrete fibre groups, said structure being capable of heat treatment to produce a structure of increased density in which the density of said fibre groups is greater than that of the remainder of the structure.

The invention includes a composition of matter in the form of a shaped article produced by a method which comprises forming a fibre structure comprising a heat shrinkable fibre, locating said structure contiguous a shaping surface, constraining said structure against shrinkage in at least one direction, subjecting said material to heat at a temperature and for a time sufficient to shrink the fibre and to obtain fibre to fibre bonding to increase the rigidity of the structure, and thereafter removing said shaped article from said surface.

The density of the structure after heat treatment may be non-uniform. Further, the structure may have a plurality of longitudinal (i.e. elongate) elements therein, each element comprising a group of said fibres oriented in a plane and densified by heat treatment.

In one embodiment of the invention, the fibre structure may comprise a layer having a plurality of longitudinal elements extending transverse the plane of said layer. In one embodiment of the invention, the groups of fibres are formed transverse to the plane of the fibre structure and are formed by needling or by hydroentangling.

The fibre structure may be a non-woven felt, typically a batt layer comprising a series of layers of separated fibres.

The fibre structure may be any type of fabric, woven or knitted in a single layer or in multiple layers.

The fabric structure may be a single batt or may be formed by several layers of batt material laminated together prior to shrinkage. Where the structure is a laminate, lamination adhesives may be employed using any type of adhesive, typically those selected from the group consisting of acrylic adhesives, polyester adhesives, polyamide adhesives, polyolefin adhesives, polyurethane adhesives and polyimide adhesives. In a preferred embodiment, the adhesive is a hot melt adhesive having low heat release properties. The fibre structure may be a felt in which lengths of fibre are oriented or random within the batt layer of the felt. The fibre structure may comprise multiple layers of batt material which have been extensively needle punched to produce cohesion between fibres within a particular layer and to produce cohesion between fibres within different layers.

In one aspect of the invention the shaped articles are plastically deformable upon reheating to temperatures in the range of the glass transition temperature of the fibres, and have a density of 1.20 g/cm$^3$ at the most.

The invention includes a light weight composition in which the density of the composition is within the range of 0.005 to 1.0 gm/cc and typically within the range of 0.125 to 0.40 gm/cc.

The fibres constituting at least a major portion of said fibre structure may be selected from heat shrinkable synthetic fibre materials including polyamide fibres, acrylic fibres, polypropylene fibres, polyphenylene sulphide fibres, polyimide fibres, aromatic ether ketone fibres and polyetherimide fibres.

The individual fibres of the fibre structure may include a proportion of not more than 5% by weight of a plasticising low molecular weight material; such plasticising material may be selected from solvents for the fibre polymer and low molecular weight oligomers of the same polymer material. Oligomers are understood to mean low molecular weight components consisting of repeat units identical to the parent polymer, but with a degree of polymerisation from about two to ten. Larger quantities may be present, but little benefit results therefrom. The solvent can be a residue from manufacture of the fibre or can be added subsequently to the fibre before heat treatment. Presence of the solvent is a desirable, but an inessential aspect of the present invention.

Where the fibres are polyimide fibres, the solvents may be selected from dimethyl formamide, N-methyl pyrrolidone and dimethyl acetamide or other strong aprotic solvent. In this particular embodiment, the heat shrinkage and/or bonding is carried out at a temperature within the range of 250°-350° C., preferably 270°-330° C., most preferably 300°-325° C.

The fibres for use in the present invention may have been subjected to a draw ratio of between 2 and 7 times, but preferably not subjected to any subsequent annealing or relaxation step. It is preferred that the fibres should be capable of an inherent shrinkage of at least 10 to 60% on heating in order to provide the appropriate shrinkage and densification of the cohesive fibre assembly.

In another embodiment of the present invention, the fibre structure comprises a major proportion of polyimide fibres having the general formula:

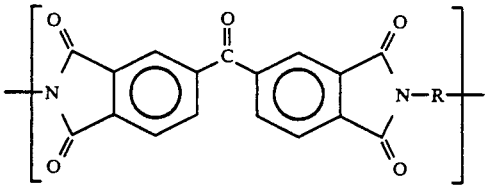

in which n is an integer greater than 1 and R is selected from one or more of

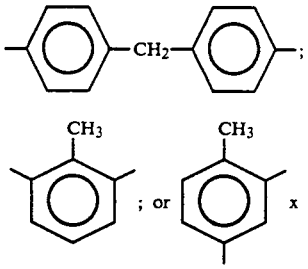

These fibres are particularly useful for practising the invention in that by heat treatment, they permit the production of shaped articles of high tensile strength, high heat resistance, good flame-retardant properties and relatively low density.

Further, they have good flame retardant properties and relatively low density. On exposure to open flames in case of a fire the fibres develop gases of only very low optical density and low toxicity.

In one aspect of the invention, the shrinkage force together with the high fibre shrinkage rate, results in the production of cohesive bonds between the individual fibres at their contact points; this is observed even in fibres such as polyimide fibres which do not have a melting point as such. These cohesive bonds, when formed, provide additional structural integrity, high stability and tensile strength of the shaped articles.

In a further aspect of the invention, there is provided a method which comprises forming a fibre structure comprising a heat shrinkable fibre, locating said structure contiguous a shaping surface, constraining said structure against shrinkage in at least one direction, subjecting said material to heat at a temperature and for a time sufficient to obtain fibre to fibre bonding to increase the rigidity of the structure, and thereafter removing said shaped article from said surface.

The fibre structure may be constrained in at least two dimensions against shrinkage thereby allowing shrinkage substantially only in the third dimension.

Where the fibre structure comprises a major proportion of polyimide fibre, the heating may be carried out at a temperature within the range of 100°-370° C. and for a time sufficient to obtain an adequate fibre to fibre bonding to produce the required increase in rigidity of the fibre structure. In this embodiment the heating may be to a temperature in excess of the effective glass transition temperature of the fibres. In the practice of the method of the invention, the groups of juxtaposed fibres having an orientation transverse to the plane of the fibre structure may include some fibres which lie in two directions, one part in the plane of the material layer and the other part in the transverse direction.

In another aspect of the invention, the fibre structure is rigidified by holding it against a shaping surface and thereafter subjecting to heat to allow substantial shrinkage of the fibres to occur to produce a densified preform. During shrinkage, groups of fibres extending in a direction transverse to each layer are densified and rigidified. Several of the densified preforms may be laminated with adhesive layer or layers between each preform layer; the adhesive may be activated by raising the temperature to a level sufficient to melt the adhesive but at a level below that at which significant rigidification occurs. This process produces a laminate in which the structural components within each layer per se impart a degree of structural rigidity to the resultant laminate material. The said transverse direction may be substantially normal to the plane of the fibre structure, but the invention is not limited thereto.

The shrinkage step may be carried out by constraining the batt in at least two directions.

In accordance with this invention the densification of the transversely disposed fibre groups may be accompanied by fibre to fibre bonding.

The fibre structure may be in the form of a woven, knitted or non-woven in which fibre lengths are oriented within the structure itself to provide uni-directional properties. In the alternative, the fibrous structure may be a batt layer or may be a paper mat. Hydraulic forming techniques may be employed whereby a slurry of short fibre lengths may be dispersed in a carrier liquid such as water and the water expressed fully in one direction to obtain partial orientation of the fibres. The fibre structure may comprise multiple layers of fibre material which have been extensively needle punched to produce cohesion between fibres within a particular layer and between fibres from different layers. Fibre to fibre bonding may be effected at an elevated temperature and the degree of bonding and corresponding degree of structural stiffness is dependent upon a time/temperature relationship.

Where the fibres are of polyimide, bonding at an elevated temperature of the order of 300°-350° C. or greater requires a relatively short exposure preferably up to 30 minutes to heat. Bonding at lower temperatures of the order of 100°-300° C., particularly in the presence of solvent moieties, will result in stiffening of, for example, a batt layer due to the increased bonding effected there. Unless the batt material is constrained, shrinkage during bonding will occur. Any heating may be effected by using an ordinary oven, an autoclave radio frequency, microwave heating or the like. In one aspect of the present invention, shrinkage of the fibre structure during the heat treatment may be controlled to give a density in the final products within the range of 0.005 to 1.2 gm/cc and preferably 0.125 to 0.40 gm/cc. This latter proposal thus permits the production of light-weight, fibrous, bonded structures. With increasing density, i.e. greater than 0.4 gm/cc, the molded products in accordance with the invention can be machined readily as by sawing, drilling, or milling, or by any tools used in the machining of wood or plastics.

In practice, in the formation of shaped components according to one aspect of the invention the fibre structure will be constrained in at least two dimensions against shrinkage, thereby allowing possible shrinkage in a third dimension. The natural tendency of the bibre structures such as those of polyimide fibres is for the structure to shrink dramatically at elevated temperatures. In accordance with the present invention, this tendency to shrink to a density in excess of 1 gm/cc may be reduced by constraining the fibre structure prior to heat treatment against shrinkage in at least two dimensions.

Accordingly, the present invention provides materials which are capable of being processed to form a light-weight formed or molded products which have structural integrity and strength based on a fibrous construction. The fibre structure in accordance with the present invention may contain a major proportion that is to say, greater than 50% of fibres, typically polyimide fibres in accordance with the present invention; in this latter case the products will have reduced flammibility compared with existing material.

Shaped articles according to the present invention may be produced by using molding means or shaping forms, i.e. a matrix. The shaping step may comprise bringing the fibre structure in close contact with the molding means and heating the fibre structure to a temperature in the range of between 280° to 350° C.; preferably 300° to 330° C.

The fibrous surface of shaped article produced in accordance with the present invention may have a high surface adhesiveness. Furthermore, the mechanical properties of the heat-treated shrunk fibres and the shaped articles produced in accordance with the described invention may be attributed at least in part to the physical linking of the fibres during shrinkage as well as to the formation of cohesive bonds between the individual fibres.

In general, the fibre structure may comprise a batt, a knit, a weave or a combination thereof. By submitting such a fibre structure to the method of the present invention and constraining the structure, for example, by clamping about the periphery of the structure, substantial shrinkage of the structure will occur in only one direction, namely perpendicular to the plane of the material and the material will thereafter retain an open, porous structure and a light weight. The effect of the bonding between the fibres is to rigidify the fibre structure. Control of the rigidity can be effected by controlling the degree of shrinkage and the degree of fibre to fibre bonding. It will be appreciated by the man skilled in the art that the level of fibre to fibre bonding can be further controlled by a combination of temperature, time residence at that temperature and by possible presence or absence of proportions of aprotic solvents such as those referred to above.

The fibre structure may be composed of continuous filament yarn or staple fibre. It will be appreciated that the properties of the final product will depend to some extent on the crimping process and on the nature of the fibre employed in the fibre structure initially. The structures and compositions in accordance with one aspect of the present invention have been found to have good dimensional stability. For example, once heat-treated, particularly at a temperature in excess of 320° C., a bonded structure of polyimide fibre was found to have dimensional stability and resistance to further deformation.

A particularly interesting aspect of the present invention is the formation of structural elements or "pillars" within a layer of material heat treated in accordance with the present invention. Where the fibre structure is caused to have a number of fibres extending generally transversely to the plane of the structure layer then by conforming such a structural layer against a shaping surface and subjecting material to a heat treatment, if the material is constrained against a forming surface, the only direction in which the material is free to shrink is in the third dimension, namely substantially perpendicular to the shaping surface. This means that the transverse fibres are capable of almost free-shrinkage, thereby markedly increasing their density relative to the open fibrous web surrounding them. Thus, at the completion of the shaping process, an article has been produced which has perhaps a slight densified surface due to any surface heating from the shaping surface employed, together with densified pillars or elements within the material and extending transverse to the surface thereof. This results in a substantial stiffening and increase in compression strength of the material.

The formation of the groups of fibres within the material can be effected by, for example, needling or by hydroentangling. Where the layer is to be needled, each structural layer may be needled from either one side or both sides either simultaneously or in succession. The size of the structural element formed within the layer during the heat shrinking step may be controlled fairly precisely by the size and nature of the needles employed in the needling operation. The more fibres that are reorientated transverse to the plane of the material, the greater is the transverse rigidity after densification. The extent of the formation of the elements or pillars within the material may be controlled by the number of penetrations. Thus, when needling, by increasing the density of needling, it is possible to enhance the compression modulus of the layer transverse to the plane of the fibre structure sample. Large transverse elements can be provided by employing extra large needles or a combination of large needle size and type of barbed structure at the end thereof.

In an alternative embodiment to the present invention, it will be appreciated that the transverse fibrous elements may be introduced into the material prior to heat shrinking by means of hydraulic entangling jets. In this embodiment, high pressure jets of fluid, typically water, may be caused to impinge upon the fibre layer surface and to drive fibres or groups of fibres into the batt material thereby aligning such fibres in a direction substantially transverse to the plane of the batt material itself.

In the shaping of the material in accordance with the present invention, the shaping surface may be a planar surface in order to produce a board or may in fact be juxtaposed spaced surfaces between which the shaping is to be effected. The shaping surface or surfaces may be curved to provide a three-dimensionally shaped resultant board or structure. In another aspect of the present invention, the fibre structure may comprise one or more layers of fibrous material which may be needled to a backing layer.

Fibres particularly useful in the practice of this invention are polyimide fibres as described above. These fibres are available as crimped staple fibre with standard titre of 1.7, 2.2 and 3.3 dtex as well as continuous filaments in the titre range of 200°–1100° dtex.

Following is a description by way of example only and with reference to the accompanying informal drawings of methods of carrying the invention into effect.

IN THE DRAWINGS

FIG. 11(A) is at 50× magnification and FIG. 11(B) is at 150× magnification.

FIG. 12 are photomicrographs produced in accordance with Example 2 showing a knot as preshrunk at 325° C. knotted and exposed at 325° C. under a 20 grams tension.

Figure 2:
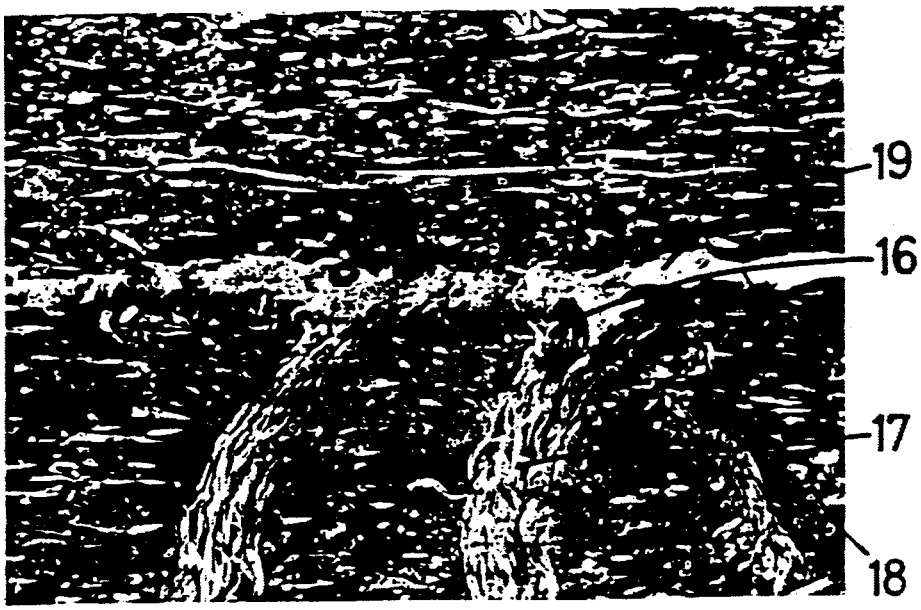
FIG. 2 is a detail of FIG. 1 at a magnification of 50 showing the pillar structure and the adhesive interface layer.
Figure 13A:
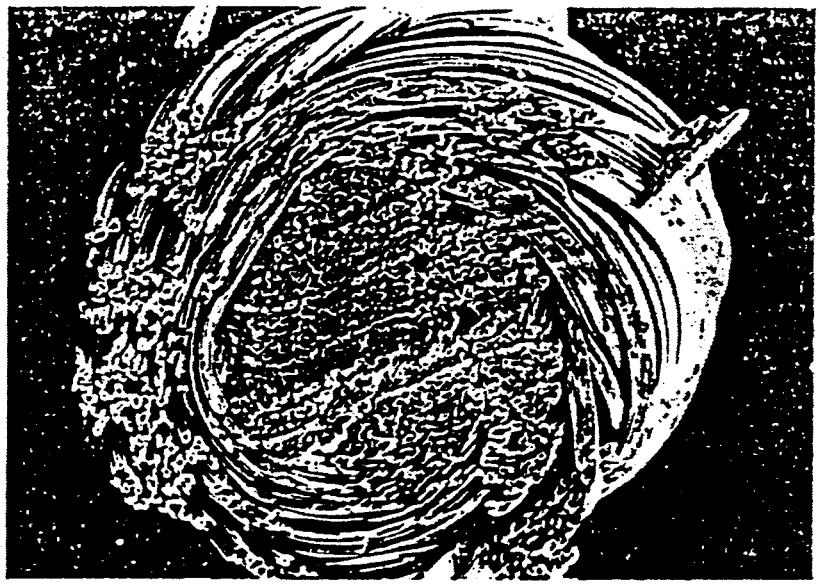
Figure 13B:
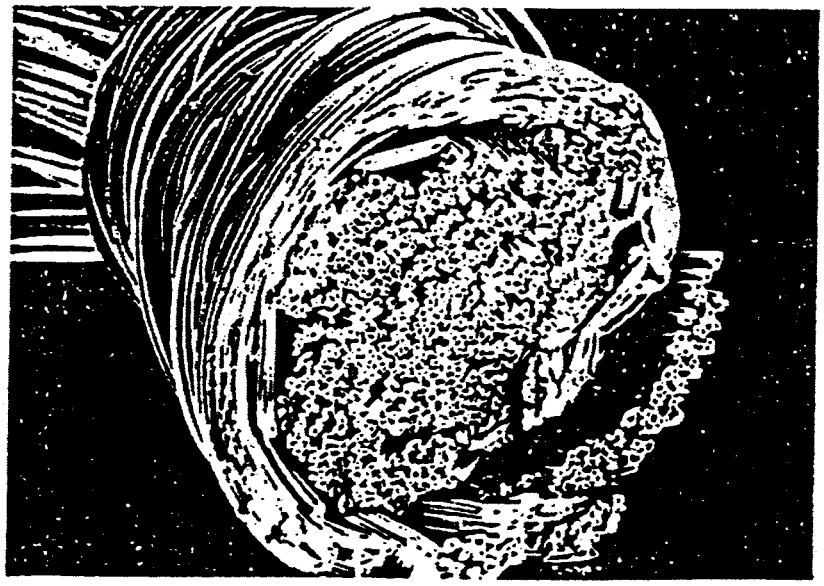
Figure 13C:
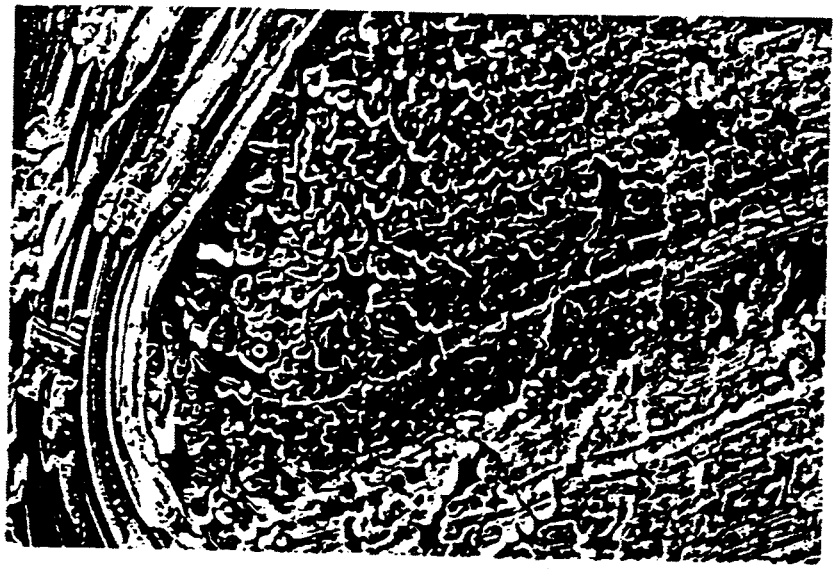

FIGS. 13 A, B and C are also in respect of the knot sample of FIG. 2; FIGS. 13 A and B both being at magnification of 150× and FIG. 13C being at a magnification of 400×.

EXAMPLE 1

Staple fibres of a polyimide were prepared from 2.2 dtex denier, approximately 60 mm long individual polyimide fibres.

The polyimide fibres described are composed of structural units of the general formula

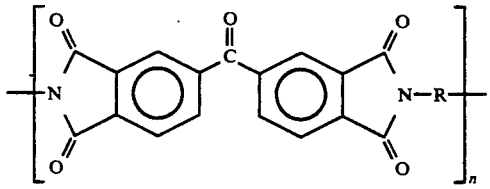

whereby R is the group

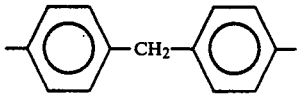

and/or the group

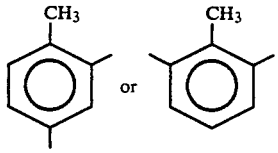

The fibres are carded and deposited in cross lapped layers. This cross-lapped fibre web is then needled to approximately 6500 penetrations per square inch which binds the layers together in a light-weight unit. This non-woven constitutes the pre-cursor material for the manufacture of a shaped article. The material has a base weight of 285 gm/m$^2$ and the fibre volume is approximately 6–7% of the total. This corresponds to a density of about 0.1 gm/cm$^3$. Precursor non-woven is secured by clamping the periphery against movement and is introduced into an oven at a temperature of 343° C. and maintained there until shrinkage had proceeded substantially to completion. The structure is then cooled and the constraint on the periphery of the material is released.

The rigidified panel thus formed has a density of about 0.24 gm/cm$^3$. Three of these panels are laminated together using a polyester adhesive. Each panel is coated with adhesive on juxtaposed sides and then placed together with their adhesive treated surfaces in contact. The laminate is placed against a curved forming surface, heated at a temperature sufficiently high to melt the polyester adhesive, but below the Tg of the fibre. Pressure is applied to the back surface of the laminate to conform the structure to the forming surface. The laminate is cooled and removed from the forming surface.

The resultant material rigidified to form a structural panel assuming the shape and finish of the surface against which it was constrained. The thickness of the fibre structure had decreased considerably during the heat treatment and the material had a rigid self-supporting structure with a pleasing surface capable of receiving decoration. The result of the needling of the batt material had produced transverse areas or "pillars" of transversely oriented fibres which fibres were substantially free of constraint during the heat shrinkage process. In those needled areas, therefore, the transversely oriented fibres were capable of maximum shrinkage and densification.

Figure 8:
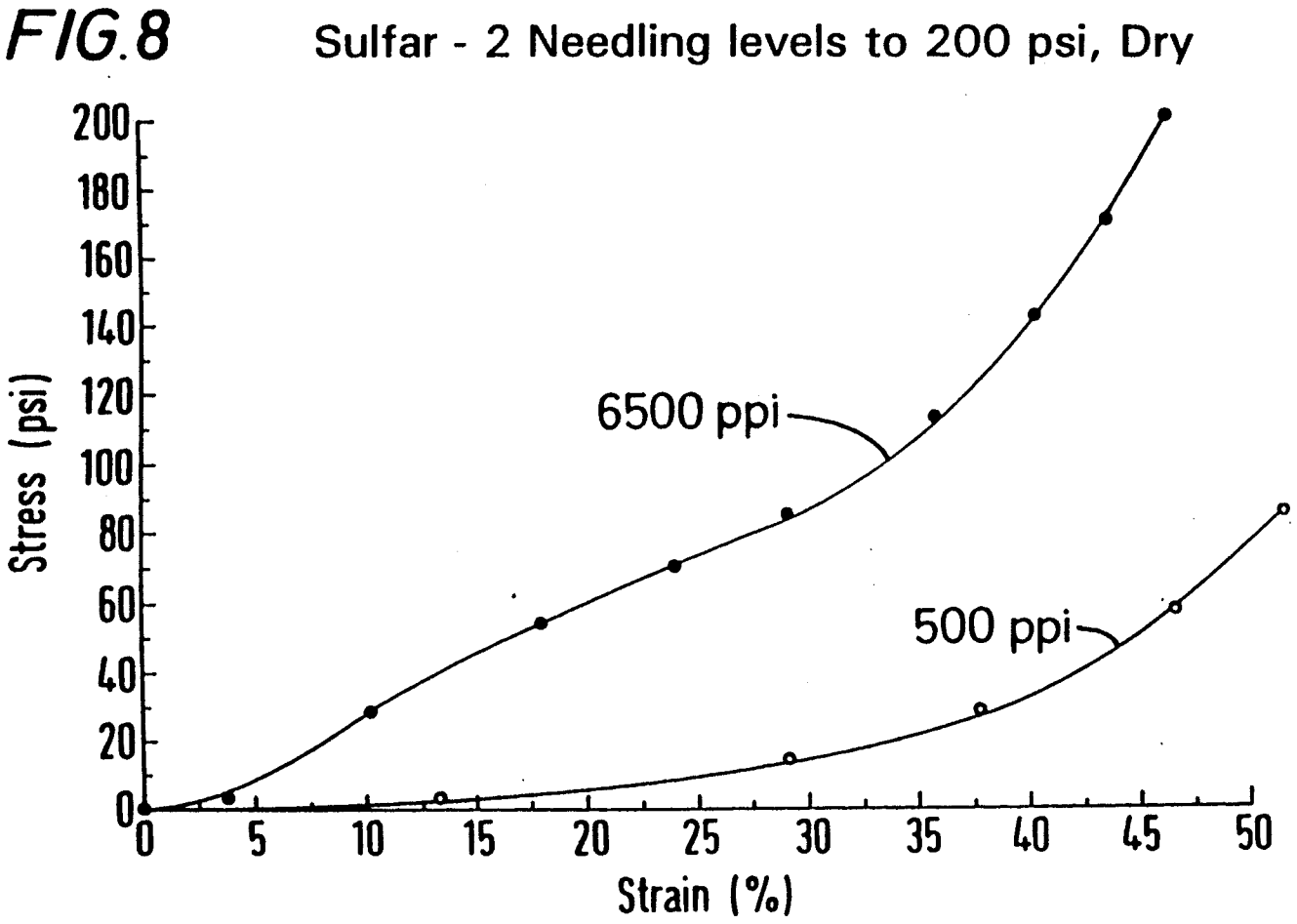
FIG. 8 shows stress-strain diagrams for compression of two polyphenylene sulfide non-woven with a different number of pillars per unit area.
Figure 9:
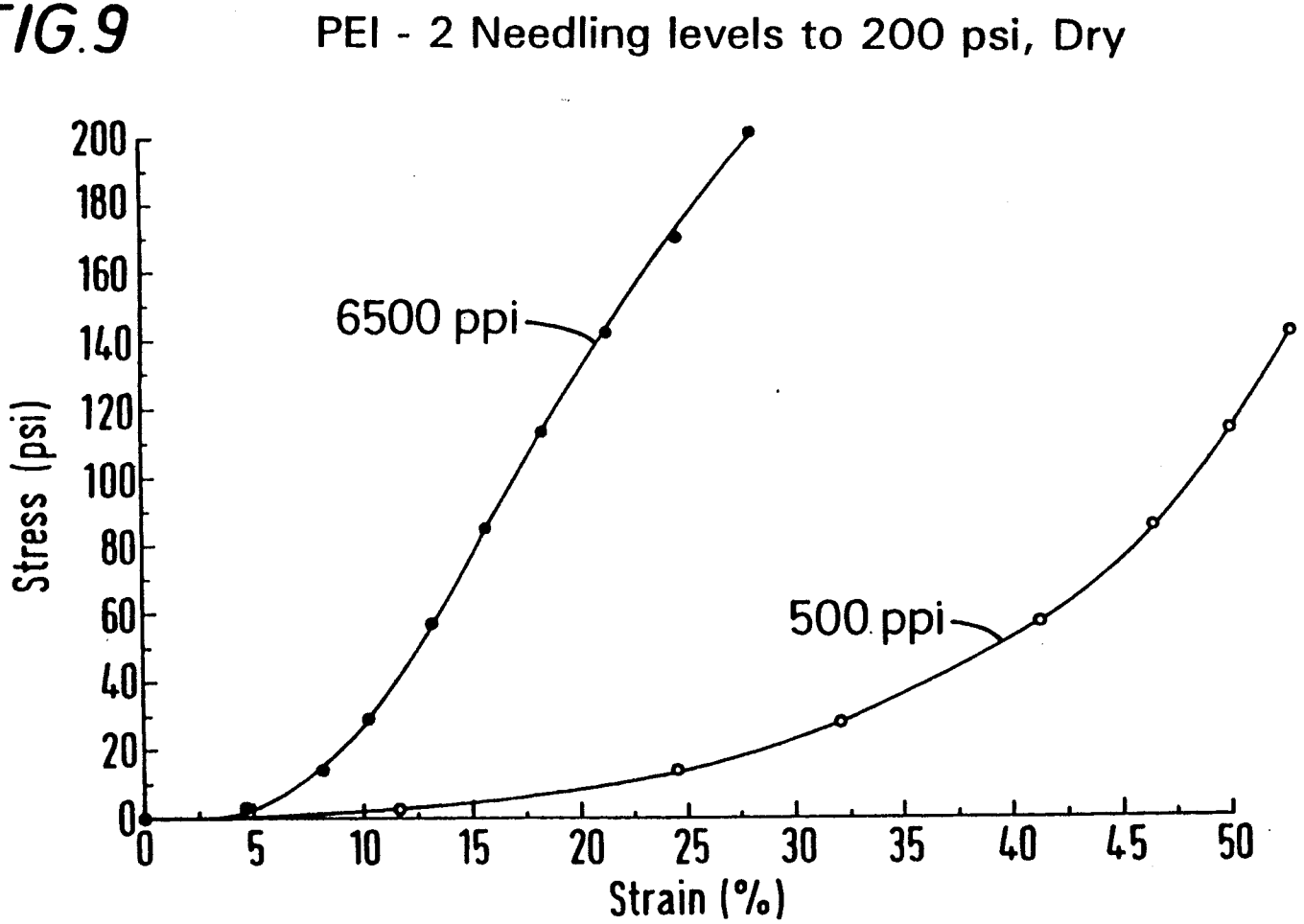
FIG. 9 shows stress-strain diagrams for compression of two polyetherimide non-woven with a different number of pillar per unit area.

The density difference between a pillar and the matrix fibrous structure is normally between a ratio of 2–3, but can be as high as 4–5. This is illustrated in FIGS. 8 and 9 which show photomicrographs of a representational pillar and matrix respectively. The fibre density of the pillar is measured to be about 70% while the matrix is about 21%, this corresponds to a ratio of 3.3.

Since these fibres were juxtaposed against either the surface layer or adhesive layers of the material, the needle fibre structures formed relatively rigid columns or pillars extending within each laminate layer, thus resulting in an increased compressional modulus transversely of the plane of material. It will be appreciated that where the needling is substantially normal to the surface of the fibrous structure prior to shrinkage, the densified "pillars or columns" of fibres will also be substantially normal to said surface.

Figure 1:
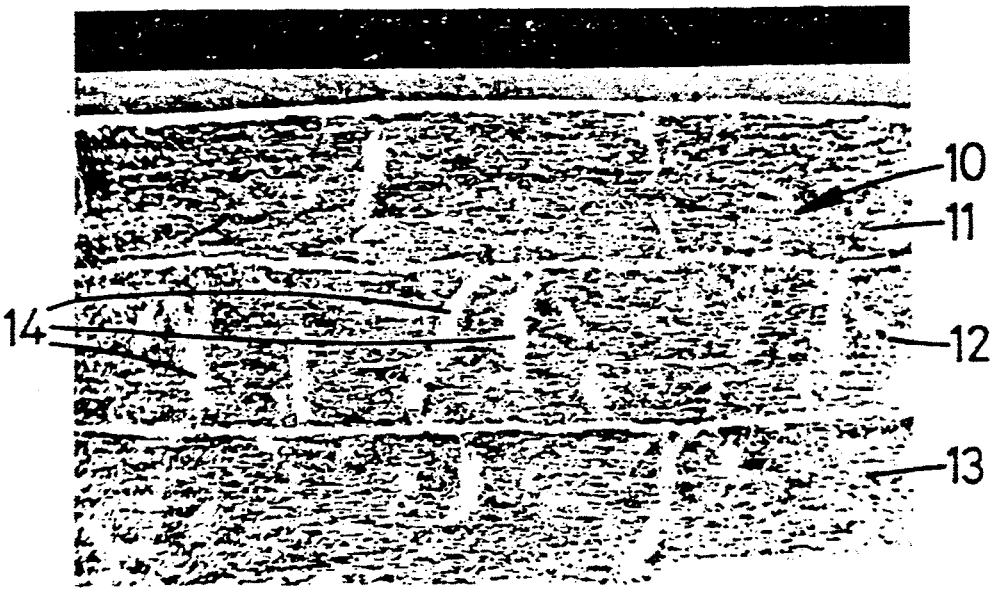
FIG. 1 is a transverse section at a magnification of 12 of a three layer laminate fibrous structure in accordance with the present invention.

This is illustrated in FIG. 1 of the accompanying drawings in which the laminate structure 10 comprises three layers 11, 12 and 13 of laminate, each layer being identically formed. The second layer 12 has a plurality of transversely extending elements of "pillars" 14 which are seen in slightly greater magnification in FIG. 2. The pillars 14 are readily discernible in which the needle hole is visible at 16 with the bundles of fibres 17 lying substantially perpendicular to the general plane containing the remainder of the fibres 18 constituting the batt layer. The polyester adhesive 19 is clearly seen in this diagram.

Figure 3:
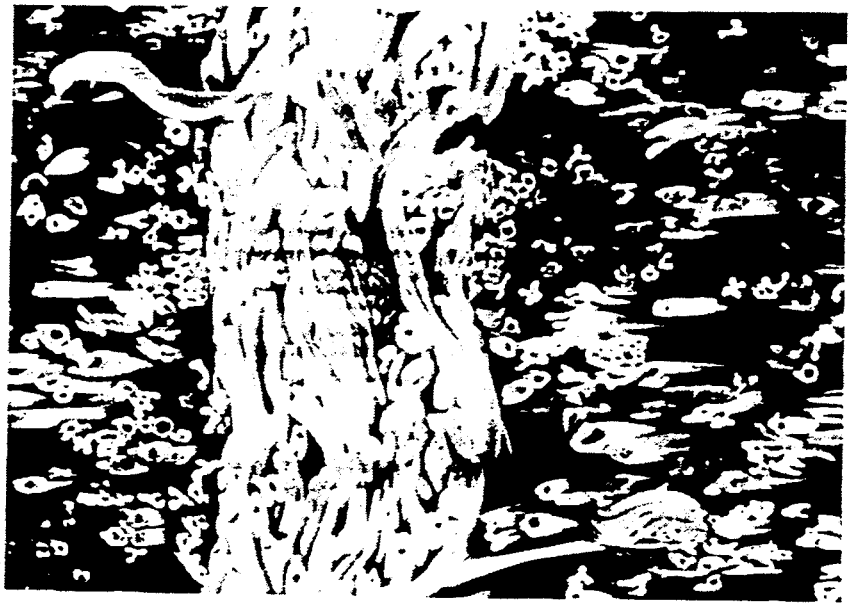
FIG. 3 is a detail of FIG. 1 at a magnification of 150 showing close up fibrous structure of a pillar.
Figure 4:
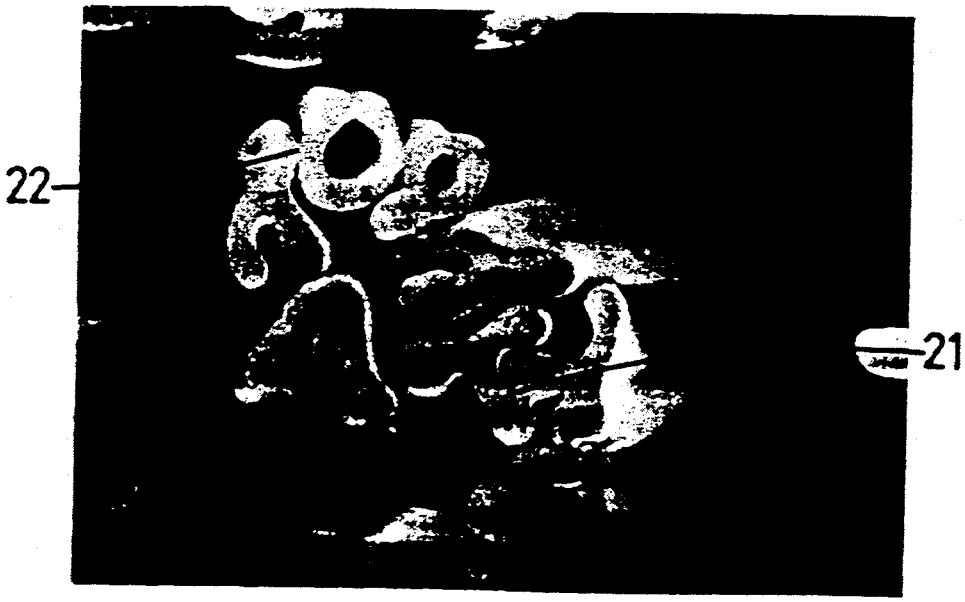
FIG. 4 is a transverse view of a pillar structure at a magnification of 950 showing the presence of fibre to fibre bonding.
Figure 6:
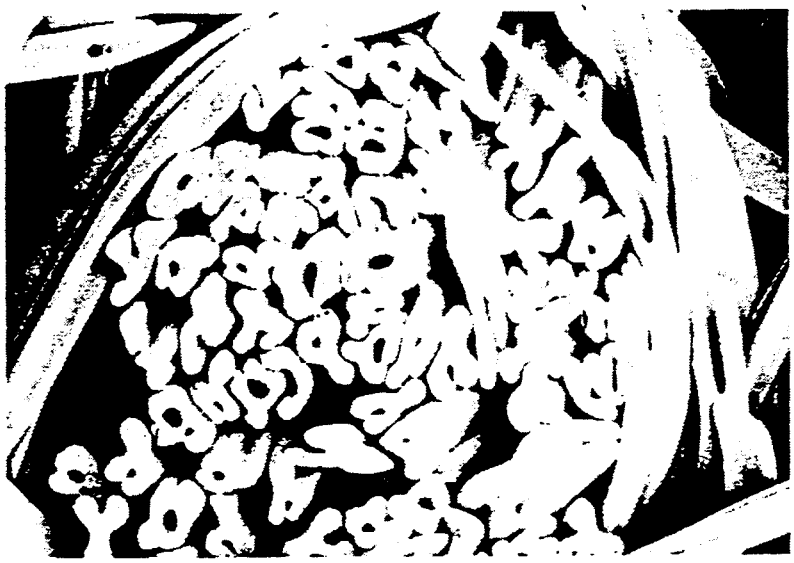
FIG. 6 shows a cross-section of a pillar structure produced by thermal densification of a needled non-woven.
Figure 7:
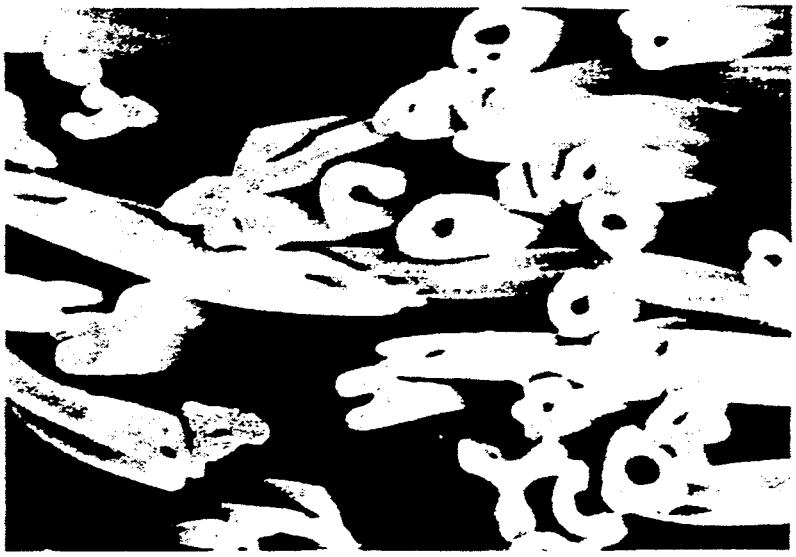
FIG. 7 shows a cross-section of the matrix fibrous structure around the pillars of a thermally densified needled non-woven.

FIG. 3 is a further enlargement showing the densification of the fibres while FIG. 4, a transverse view of the pillar structure, shows clear evidence of bonding, see areas marked 21 and 22 of FIG. 6.

EXAMPLE 2

An experiment was performed in which two non-wovens differing principally in the number of pillars present per unit area were prepared and tested to determine compression and bending properties. The samples were prepared by thermal shrinkage of a polyimide non-woven structure as described in Example 1. The shrinkage process was controlled so as to provide samples with approximately the same thickness and density, and differing substantially only in the number of needle penetrations per inch used in preparing the precursor non-woven. It should be understood that each needle penetration gives rise to formation of a pillar structure in the densified, heat treated structure. The two samples had needling density, thickness and density as shown below.

| Needling density (penetrations per inch) | Thickness at 20.7 kPa (mm) | Density (gm/cm$^2$) |
|---|---|---|
| 500 | 5.25 | 0.30 |
| 6500 | 4.88 | 0.33 |

Figure 5:
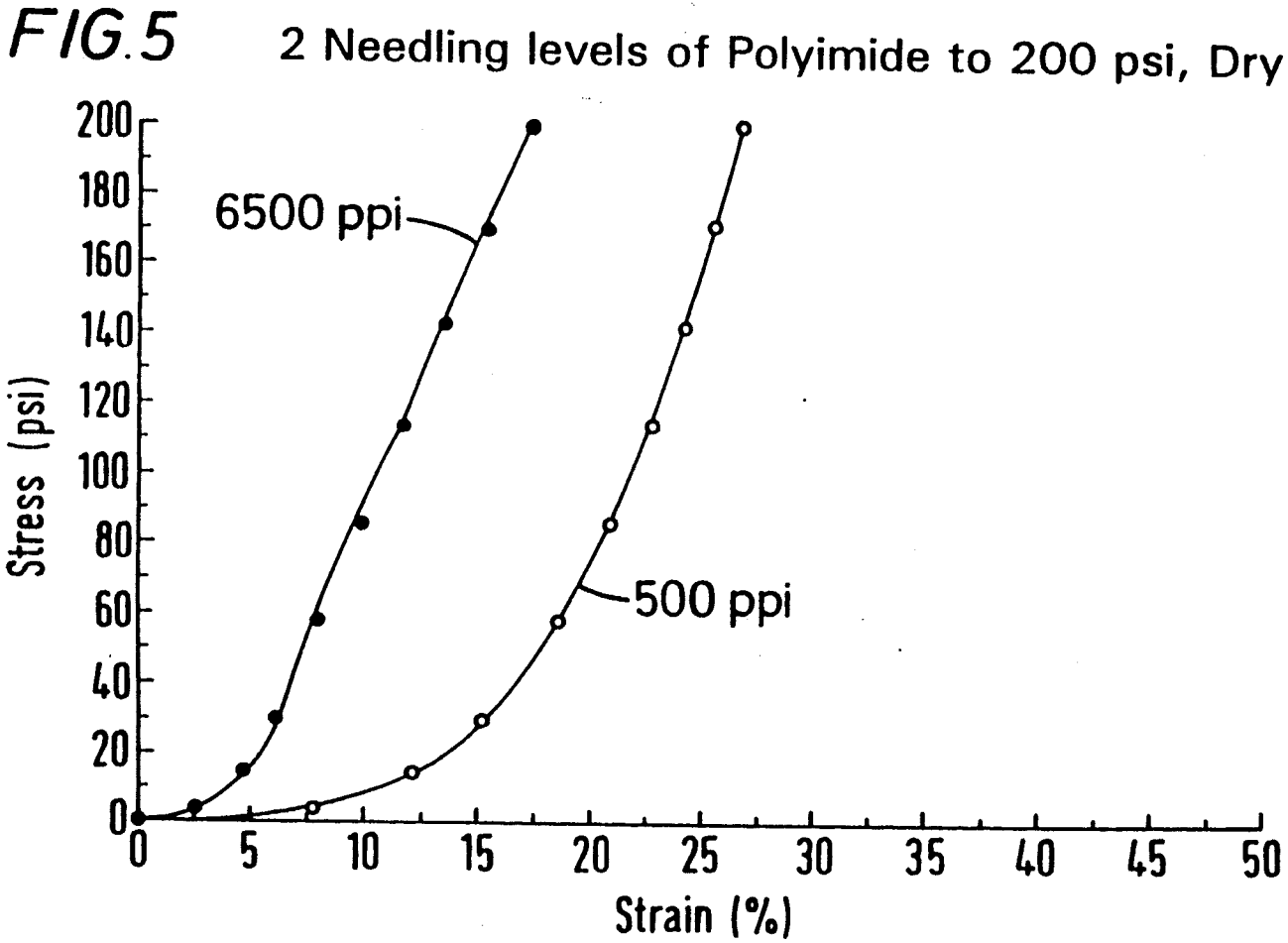
FIG. 5 shows stress-strain diagrams for compression of two polyimide non-woven with a different number of pillars per unit area.

Two, 7.6 cm diameter specimens from each felt sample were compressed between steel platens in an Instron universal test machine to 1379 kPa. In FIG. 5, the average stress-strain properties of the two felts are compared. As shown, the felt with the greater number of needling penetrations per inch, is much more resistant to compressive deformation than the felt needled less.

The bending modulus of the two felts were measured by a three-point bending technique using 2.5 cm wide specimens cut with their long direction aligned with the direction of needling. This test direction, with the majority of fibres in the cross-layed web oriented perpendicular to the plane of bending, was chosen because it is likely to be more sensitive to changes in structural organisation than bending in the direction of principal fiber orientation. Using a span of 10.2 cm between supports, the following bending modulus values were calculated from the slope of the load-deflection curve:

| Needling Density (ppi) | Bending Modulus ($10^3$ kPa) | |
|---|---|---|
| 500 | 51.0 | needled surface in compression |
| | 22.1 | needled surface in tension |
| | 36.6 | average |
| 6500 | 148.9 | needled surface in compression |
| | 151.0 | needled surface in tension |
| | 150.0 | average |

As indicated in the table, the more highly needled sample is more than four times stiffer in bending on average than the less well-needled sample.

EXAMPLE 3

Two sets of samples were made and tested by procedure analogous to that of Example 2. The samples are identified in the table below; Sulfar refers to fibre prepared from polyphenylene sulfide, PEI refers to fibre made from polyetherimide.

| Fibre Type | Needling Density | Thickness at 4.1 kPa(mm) | Density (gm/cm) |
|---|---|---|---|
| Sulfar | 500 | 9.98 | 0.17 |
| Sulfar | 6500 | 7.98 | 0.24 |
| PEI | 500 | 8.56 | 0.15 |
| PEI | 6500 | 7.92 | 0.24 |

The average stress-strain properties of the felt pairs when tested in compression between two steel platens on an Instron Universal test machine are given in FIG. 8 and FIG. 9 for the Sulfar and PEI samples respectively. It can be seen that the samples with the higher needle density and thus the higher number of pillars per unit area give increased resistance to compression.

The bending modulus of each felt pair was also measured analogous to Example 2. These data shown below again show increased stiffness in the samples with higher density of pillars.

| Sample | Needling Density | Bending Modulus Av. of two Samples ($10^3$ kPA) |
|---|---|---|
| Sulfar | 500 | 5.5 |
| Sulfar | 6500 | 55.8 |
| PEI | 500 | 10.3 |
| PEI | 6500 | 31.0 |

This Example shows that an increase in compressive strength and bending modulus by the presence of a high density of pillar structure in a fibrous matrix produced by the present invention is a general phenomenon applicable to more than one polymer type.

EXAMPLE 4

A number of experiments were performed with a knotted continuous filament yarn exposed at a temperature of 325° C. in order to determine the conditions under which inter-filament bonding of polyimide fibres occurs. The polyimide employed is that described in Example 1. Simple overhand knots were tied both in yarn specimens that had seen no previous elevated temperature exposure and in those that had been previously annealed and/or pre-shrunk. For subsequent exposure the knotted yarns were wrapped round a steel frame to restrain them to length in all but one case. A complete set of conditions apply as described in the table.

Figure 10A:
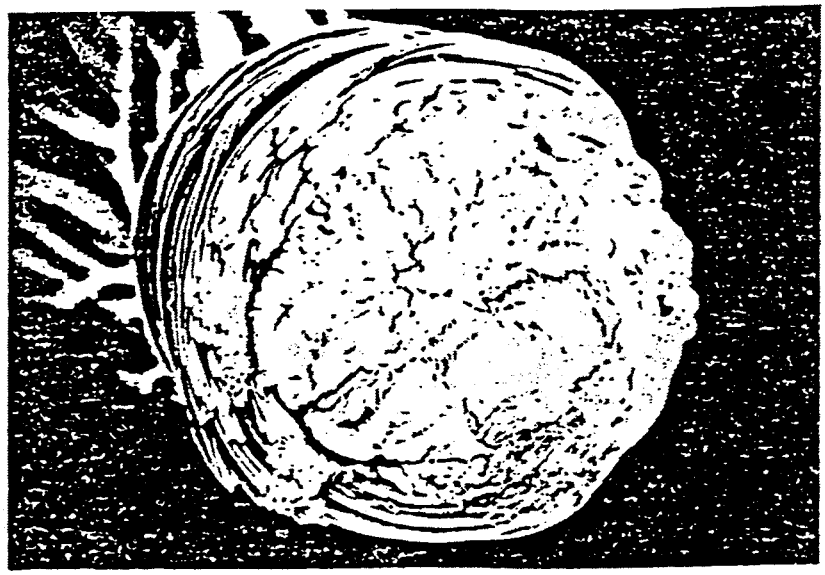
FIG. 10 is a view of the control knot of Example 2 (A) at a magnification of 150× and (B) at a magnification of 400×.
Figure 10B:
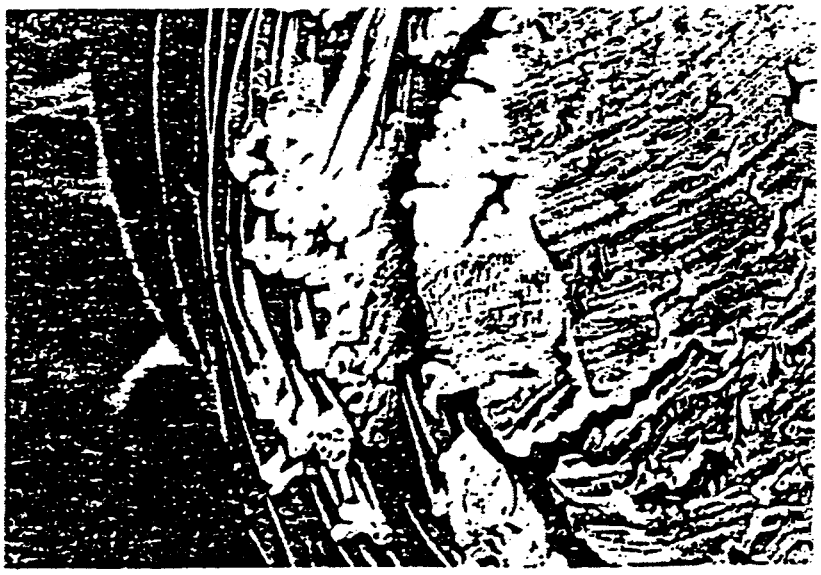
Figure 11:
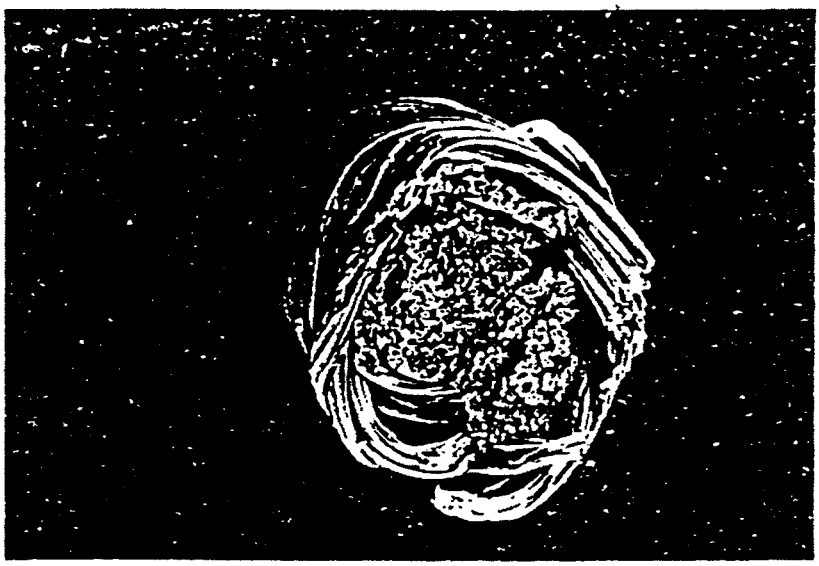
FIG. 11 is a photomicrograph of a knot in accordance with Example 2 preshrunk at 325° C. and exposed to a temperature of 325° C. under restraint.
Figure 11:
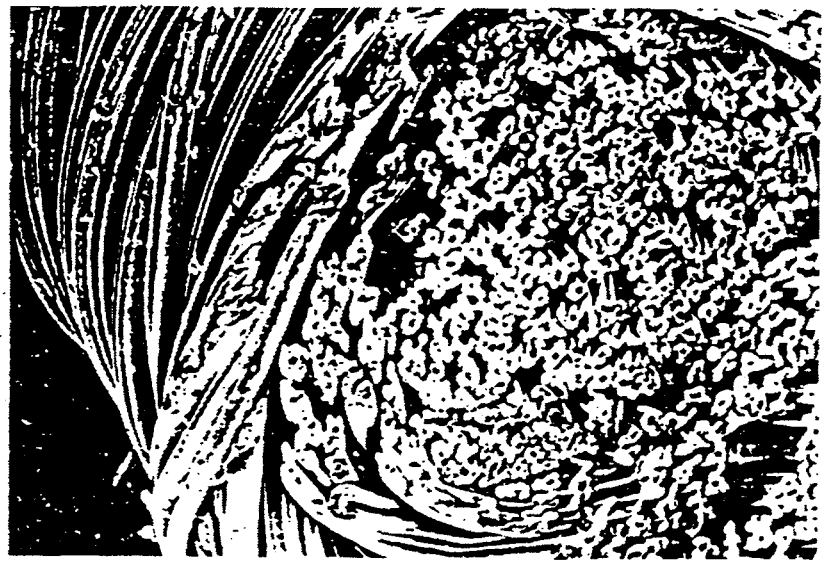
Figure 12A:
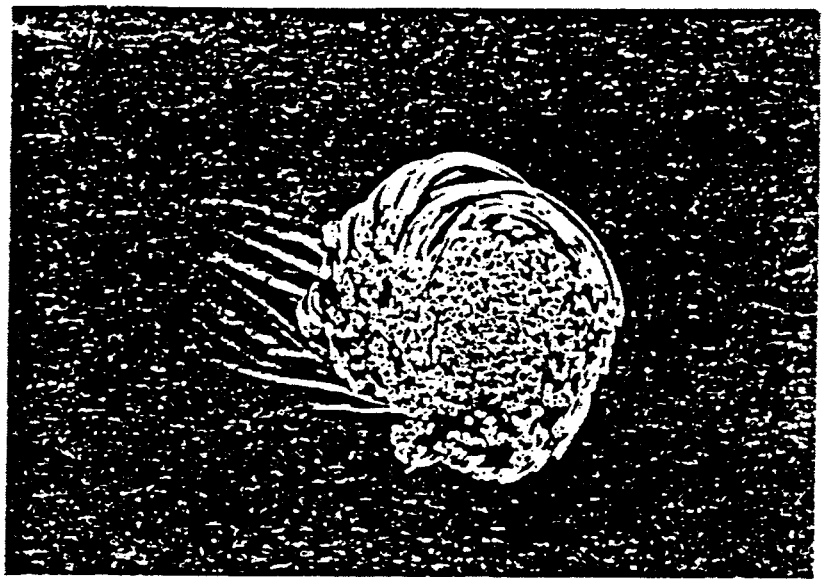
FIG. 12(A) is a magnification of 50× and FIG. 12(B) is a magnification of 150×.
Figure 12B:
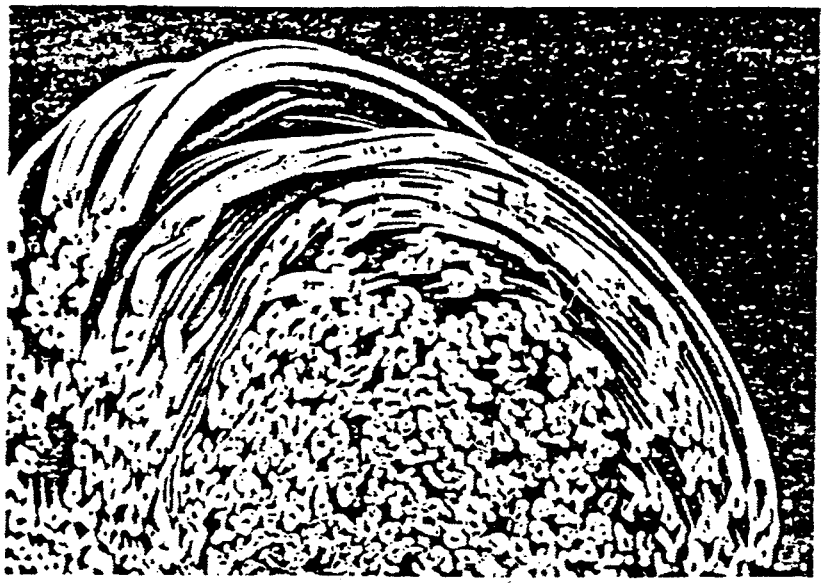

Although the length restraint was applied, it was obvious that shrinkage forces and/or shrinkage itself worked to tighten the knots during exposure. The tightening was minimal for fully pre-shrunk yarns. One set of pre-shrunk knotted specimens was tensioned during exposure to about half it's breaking load. Photomicrographs of sectioned knots are set out in FIGS. 10 to 13. Extended bonding occurs between the fibres in the knot of the previously unexposed control yarn even through shrinkage was restrained, see, for example, FIG. 10. The material in the knot area is glossy as if it had melted and flowed together during the course of heat treatment. When the control yarn was fully pre-shrunk, i.e. of the order of 60% shrinkage, no bonding on subsequent exposure was observed, even when tension was applied to tighten the knot during heating. This can be seen from FIGS. 13 and 14 of the accompanying drawings. When the yarn was restrained to length during the exposure then knotted and re-heated under no restraint, little or no bonding was observed, see, for example, FIG. 15.

From the foregoing experiments it would seem that shrinkage per se is not a factor in the occurence of bonding. Previous exposure to elevated temperatures prevents or at least severely limits the tendency of the fibres to bond together. bonding can only occur when sufficient force is applied. In most structures, that force is the fibre shrink force. If no shrinkage force is available, then some other form of external mechanical force must be applied in order for bonding to occur.

TABLE 1

| | Exposure Conditions for Knotted, Continuous-Filament P-84 Yarn | | |
|---|---|---|---|
| | Pre-Exposure Conditions | Knot Exposure Conditions | Extent of Interfilament Bonding |
| Control | None | Free shrinkage | Extensive |
| | None | 325° C. (10 min) restrained to length | Extensive (FIG. 10) |
| | 325° C. (10 min) free shrinkage (−60%) | 325° C. (10 min) restrained to length | None (FIG. 11) |
| | 325° C. (10 min) free shrinkage | 325° C. (10 min) 20 g applied | None (FIG. 12) |
| | (−60%) 325° C. (10 min) restrained to length | tension 325° C. (10 min) free shrinkage (−13%) | Minor amount in one knot, none in another (FIG. 13) |

EXAMPLE 5

Two panels were produced from polyimide fibre as described in Example 1 in accordance with the present invention, but through using different treatments to produce identical final densitites. Felt sample A was produced from polyimide having an initial density of 0.12 gm/cm$^3$. This felt was restrained 100% in a 16.5 cm diameter circular frame and treated at a temperature of 326° C. for one hour. The final density of the panel was 0.253 gm/cm$^3$. Felt sample B had an initial density of 0.08 gm/cm$^3$. This felt was restrained to allow for 30% shrinkage in a 16.5 cm diameter circular frame and again, treated at a temperature of 326° C. for a period of one hour. The final density of the resultant panel was 0.255 gm/cm$^3$. The difference between the final densities was 0.002 gm/cm$^3$ or 0.6%. The properties are set out in the table below as follows.

TABLE 2

| | 30% Shrinkage TENSILE TEST | | 100% Restrained TENSILE TEST | |
|---|---|---|---|---|
| | Cross Machine | Machine | Cross Machine | Machine |
| Peak Load | 55.8 Kg | 68.5 Kg | 64.9 Kg | |
| U.T. Strength | $1.10 \times 10^4$ kPa | $1.35 \times 10^4$ kPa | $1.52 \times 10^4$ kPa | |
| Yield Strength | $3.44 \times 10^3$ kPa | $4.48 \times 10^3$ kPa | $5.52 \times 10^3$ kPa | |
| Modulus | $1.06 \times 10^5$ kPa | $1.18 \times 10^5$ kPa | $1.56 \times 10^5$ kPa | |

From Table 2 it will be apparent that from the physical test, the panel which was 100% restrained performed approximately 30% better in tensile properties than the panel which allowed 30% shrinkage.

EXAMPLE 6

A number of samples of polyimide felt comprised of polyimide fiber as described in Example 1, were tested for thermal stability after heat setting. Two pieces of felt were fully restrained in a 16.5 cm round mold. Sample A was treated at 315° C. for one hour and Sample B was treated at 343° C. for one hour. Both samples were then cut into 10.2 cm × 10.2 cm squares and the samples were allowed to pre-shrink for 15 minutes at each of the temperatures listed below. Dimensions were taken after each temperature and the percentage linear shrinkage calculated. The results are set out in the following Table 3.

TABLE 3

| Temperature (°C.) | Dimensions (cm) | Linear Shrinkage (%) |
|---|---|---|
| | Sample 14 Heat Set at 315° C. | |
| 304 | 10.1 × 10.1 | 1.0 |
| 310 | 10.0 × 10.0 | 1.5 |
| 315 | 9.25 × 9.25 | 9.0 |
| 321 | 8.99 × 8.99 | 11.5 |
| 327 | 7.57 × 7.57 | 25.5 |

TABLE 3-continued

| Temperature (°C.) | Dimensions (cm) | Linear Shrinkage (%) |
|---|---|---|
| 332 | 6.70 × 6.75 | 33.8 |
| 338 | 6.32 × 6.35 | 37.6 |
| 343 | 6.10 × 6.10 | 40.0 |
| 349 | 6.10 × 6.10 | 40.0 |
| 354 | 6.10 × 6.10 | 40.0 |
| 360 | 6.07 × 6.07 | 40.2 |
| 366 | 6.02 × 6.05 | 40.6 |
| 371 | 6.02 × 6.05 | 40.6 |
| | Sample B | |
| | Heat Set at 343° C. | |
| 304 | 10.1 × 10.1 | 0.2 |
| 310 | 10.1 × 10.1 | 0.5 |
| 315 | 10.1 × 10.1 | 0.5 |
| 321 | 10.1 × 10.1 | 1.0 |
| 327 | 10.0 × 10.0 | 1.5 |
| 332 | 9.91 × 9.91 | 2.5 |
| 338 | 9.70 × 9.70 | 4.5 |
| 343 | 9.42 × 9.42 | 7.2 |
| 349 | 9.25 × 9.25 | 9.1 |
| 354 | 9.14 × 9.09 | 10.2 |
| 360 | 9.09 × 9.04 | 10.7 |
| 366 | 9.04 × 8.99 | 11.2 |
| 371 | 9.04 × 8.99 | 11.2 |

We claim:

1. A fibre structure formed from a layer comprising a major proportion of heat shrinkable organic fiber, characterized in that said structure includes discrete fiber groups which extend in the thickness direction transverse the longitudinal plane of the layer, and in that said structure on heat treatment produces a structure of increased density in which the density of said discrete fiber groups is greater than the density of the remainder of the structure.

2. A fibre structure as claimed in claim 1 in the form of a shaped article, said shaped article being produced by a method which comprises forming a fibre structure comprising a heat shrinkable fibre, said structure having said discrete fibre groups, locating said structure contiguous to a shaping surface, constraining said structure against shrinkage in at least one direction, and, either prior to or simultaneous with said locating step, subjecting said material to heat at a temperature and for a time sufficient to obtain a structure of increased density in which the density of the fibre groups is greater than the remainder of the structure, and thereafter removing said shaped article from said surface.

3. A fibre structure as claimed in claim 2, characterized in that said material has been subjected to heat at a temperature and for a time sufficient to shrink the fibre to obtain fibre-to-fibre bonding.

4. A fibre structure as claimed in claim 1, characterized in that said discrete fibre groups have been densified and rigidified to form a structural component within the structure per se to impart a degree of structural rigidity to the resultant structure.

5. A fibre structure as claimed in claim 4, characterized in that the structure has been subjected to a treatment comprising heating to a temperature sufficient to allow densification to occur while constrained against shrinkage in at least one direction, locating said structure contiguous to a shaping surface while maintaining said constraint, continuing to constrain said structure during cooling and thereafter removing said constraint.

6. A fibre structure as claimed in claim 5, characterized in that the fibre structure has been constrained in at least two dimensions against shrinkage thereby allowing shrinkage substantially only in the third dimension.

7. A fibre structure as claimed in claim 5, characterized in that the shaping surface comprises at least two cooperating surfaces which cooperate to produce a three dimensional contoured panel.

8. A fibre structure as claimed in claim 1, characterized in that said structure has a plurality of elongate elements therein, each element comprising a group of fibres oriented in a plane and densified by heat treatment.

9. A fibre structure as claimed in claim 1, characterized in that said structure is selected from the group consisting of non-woven felts, knitted materials and woven materials.

10. A fibre structure as claimed in claim 9, characterized in that said structure is a batt comprising a series of separate fibre layers.

11. A fibre structure, characterized in that said structure is formed by several layers of fibre material as defined in claim 1 laminated together.

12. A fibre structure as claimed in claim 11, characterized in that said layers are laminated together by adhesives, said adhesives being selected from the group consisting of acrylic adhesives, polyester adhesives, polyamide adhesives, polyolefin adhesives, polyurethane adhesives and polyimide adhesives.

13. A fibre structure as claimed in claim 1, characterized in that said fibre groups are formed by needling or by hydroentangling.

14. A fibre structure as claimed in claim 1, characterized in that the density is within the range of 0.005 to 1.2 gm/cc.

15. A fibre structure as claimed in claim 1, said fibre structure being a felt layer in which fibre lengths are oriented within the plane of the felt layer.

16. A fibre structure as claimed in claim 15, said fibre structure comprising multiple felt layers and characterized in that oriented fibres are disposed in discrete laminae within each layer, said laminae being arranged such that the orientation directions of adjacent laminae define an angle greater than 5°.

17. A fibre structure as claimed in claim 1, characterised in that the fibres constituting said major proportion of the fibres of said structure are heat shrinkable fibres selected from the group consisting of polyamide fibres, acrylic fibres, polypropylene fibres, polyphenylene sulphide fibres, polyimide fibres, aromatic ether ketone fibres and polyetherimide fibres.

18. A fibre structure as claimed in claim 1, characterized in that the individual fibres thereof include a proportion of not more than 5% by weight of a plasticizing low molecular weight material.

19. A fibre structure as claimed in claim 1, characterized in that said low molecular weight plasticizing material is selected from the group consisting of solvents for the fibre polymer and low molecular weight oligomers of the same polymer material.

20. A fibre structure as claimed in claim 18, characterized in that the fibres are polyimide fibres and the plasticising material is a solvent selected from the group consisting of dimethyl formamide, N-methyl pyrrolidone, N-vinyl pyrrolidone and dimethyl acetamide.

21. A fibre structure as claimed in claim 1, said structure being a laminated assembly formed from several layers of rigidified non-woven material, said structure having groups of fibres extending in thickness the direction transverse the longitudinal plane of each layer, and said structure being shaped to allow said groups of densified fibres to form a structural component within each layer per se to impart a degree of structural rigidity to the resultant laminate.

22. A fibre structure as claimed in claim 1, characterized in that the fibres of said structure have been subjected to a draw ratio during forming of between 2 and 7 times.

23. A fibre structure as claimed in claim 1, characterized in that the fibres are capable of an inherent shrinkage of at least 15 to 80% on heating in order to provide the appropriate shrinkage and densification of the cohesive fibre assembly.

24. A fibre structure as claimed in claim 1, said fibre structure comprising a major proportion of polyimide fibres based on units of the general formula

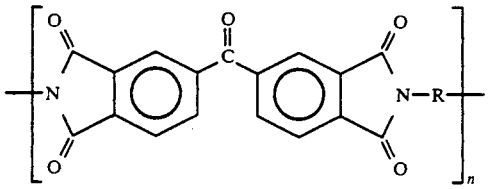

wherein n is an integer greater than 1 and R is the group

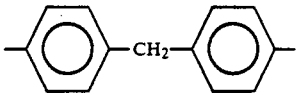

and/or the group

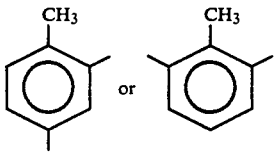

25. A method of producing a fibre structure in the form of a shaped article, said method comprising forming a fibre structure comprising heat shrinkable fibres as claimed in claim 1, heating said structure to a temperature sufficient to allow densification to occur while constraining said structure against shrinkage in at least one direction, locating said densified structure contiguous to a shaping surface while maintaining said constraint, cooling said structure while maintaining said constraint, and thereafter removing said constraint.

* * * * *